US009502200B1

(12) United States Patent
Fleege

(10) Patent No.: US 9,502,200 B1
(45) Date of Patent: Nov. 22, 2016

(54) LOW TOLERANCE MAGNETIC TRIP FOR A MINIATURE CIRCUIT

(71) Applicant: SCHNEIDER ELECTRIC USA, INC., Schaumburg, IL (US)

(72) Inventor: Dennis William Fleege, Cedar Rapids, IA (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 14/961,943

(22) Filed: Dec. 8, 2015

(51) Int. Cl.
*H01H 75/12* (2006.01)
*H01H 71/40* (2006.01)
*H01H 71/52* (2006.01)

(52) U.S. Cl.
CPC ..... *H01H 71/40* (2013.01); *H01H 71/528* (2013.01); *H01H 2205/002* (2013.01)

(58) Field of Classification Search
CPC ..... H01H 71/40
USPC ..... 335/6, 35
See application file for complete search history.

(56) References Cited

U.S. PATENT DOCUMENTS 3,200,217 A * 8/1965 Bullis, Jr. ..... H01H 71/40 335/36
4,604,596 A * 8/1986 Yokoyama ..... H01H 89/10 335/14
5,294,902 A * 3/1994 Pannenborg ..... H01H 21/20 335/35
7,397,333 B2 * 7/2008 Fleege ..... H01H 71/7418 335/35
8,149,075 B2 * 4/2012 Navarre ..... H01H 71/524 335/21
2002/0011908 A1 * 1/2002 Kim ..... H01H 71/123 335/35
2008/0084266 A1 * 4/2008 Fleege ..... H01H 71/16 337/72
2008/0094155 A1 * 4/2008 Fleege ..... H01H 71/7418 335/6

* cited by examiner

*Primary Examiner* — Alexander Talpalatski
(74) *Attorney, Agent, or Firm* — Locke Lord LLP

(57) ABSTRACT

A trip assembly for a circuit breaker includes a trip lever and a trip actuator. The trip lever causes electrical contacts, which are in a closed position, to disengage from each other into an open position and interrupt current flow to a circuit, when tripped by the trip actuator due to an overcurrent condition. The trip actuator includes a bimetallic member, a yoke and an armature with an opening in which an end of the trip lever is latched in the closed position. The yoke includes a tab adjacent to the opening. When the trip lever is latched in the opening, the end of the trip lever includes first, second and third surfaces that contact a front surface of the armature, an interior surface of the armature defining the opening, and the tab of the yoke, respectively, to provide a consistent magnetic gap between the back side of the armature and the yoke.

9 Claims, 3 Drawing Sheets

LOW TOLERANCE MAGNETIC TRIP FOR A MINIATURE CIRCUIT

FIELD

The present disclosure relates to a trip assembly for a circuit breaker, and more specifically, to a trip assembly capable of maintaining a consistent magnetic gap between an armature and a yoke of a magnetic-type trip actuator in an untripped position.

BACKGROUND

A circuit breaker is an overcurrent protective device that is used for circuit protection and isolation. The circuit breaker provides electrical system protection when an overcurrent condition, such as an electrical abnormality due to a short circuit or an overload event (e.g., over heating), occurs in the system. One type of circuit breaker is a miniature circuit breaker (MCB), which is typically used for low voltage applications. An MCB can include a base and cover, and an electrical path between a line terminal and a load terminal. The electrical circuit includes a conductive stationary contact electrically connected to one of the terminals and a movable contact electrically connected to the other terminal. The movable contact is secured on a movable blade (also referred to as a contact carrier). A handle interfaces with the blade and a trip lever of the trip assembly. The handle can be operated by a user to move the blade, and thus the movable contact, between an open position and a closed position (also referred to as ON position) to open or close the electrical circuit. In the closed position, the movable contact is engaged with the stationary contact to allow current flow between the two contacts to a protected load. In the open position, the movable contact is disengaged from the stationary contact to prevent or interrupt current flow to the protected load.

The MCB has a trip assembly that, when unlatched to the tripped position, causes the blade to move to an open position in the event of an overcurrent condition. The trip assembly can include a trip lever, which is connected to the blade via a toggle spring (also known as a "tension spring"), and a trip actuator to move the trip lever to the tripped position. The trip actuator can include a bimetallic member electrically connectable to the protected circuit, a yoke and a movable armature. The trip lever is latched in an opening of the armature when the circuit breaker is in the closed position. In the event of an overcurrent condition such as due to a short circuit, the bimetallic member generates a magnetic field which, in turn, generates a magnetic flux in the armature and the yoke that are separated by a magnetic gap. The magnetic flux causes the armature to move toward the yoke, thereby unlatching the trip lever from the armature into the tripped position.

The magnetic gap of the trip actuator plays a critical role in the tripping operation (e.g., trip sensitivity and timing) for overcurrent protection, particularly against short circuits. The magnetic gap is a function of the inverse square of the distance between the two parts, namely the armature and the yoke. Thus, the magnetic gap needs to be as small as possible to have the most effect on the attraction between these two parts of the trip actuator. However, the trip actuator in some existing circuit breakers is susceptible to wider part/component tolerances (e.g., part pivots, stops, etc.), which result in inconsistencies or variances in the magnetic gap due to the number and location of parts that determine the magnetic gap. These variances can result in inconsistent tripping among circuit breakers because the magnetic gap has a non-linear effect on forces that pull the armature and yoke together.

SUMMARY

To address these and other shortcomings, a circuit breaker is provided with a trip assembly design that is able to control a magnetic gap between a yoke and armature of a trip actuator with parts that are contained in a small or localized area of the circuit breaker, thereby providing for smaller part/component tolerances. In this way, the trip actuator of the trip assembly can have a consistent magnetic gap between the yoke and the armature, which results in predictable tripping levels for the circuit breaker.

For example, a circuit breaker includes first and second electrical contacts, and a trip assembly. The first electrical contact is connected to a first terminal. The second electrical contact, which is movable, is engaged to the first contact in a closed position and is disengaged from the first contact in an open position. The trip assembly includes a trip lever and a trip actuator. The trip lever causes the electrical contacts, which are in a closed position, to disengage from each other into an open position and interrupt current flow to a circuit, when tripped by the trip actuator due to an overcurrent condition such as a short circuit. The trip actuator includes a bimetallic member, a yoke and an armature with an opening in which an end of the trip lever is latched, such as when the electrical contacts are in the closed position. The yoke includes a tab which is arranged adjacent to the opening. When the trip lever is latched in the opening, the end of the trip lever includes first, second and third surfaces that contact: a front surface of the armature, an interior surface of the armature defining the opening, and the tab of the yoke, respectively, to provide a consistent magnetic gap between the back side of the armature and the yoke. The tab of the yoke, the opening of the armature and the first, second and third surfaces of the trip lever are all situated in a localized area to allow for small part/component tolerances, and thus, greater control over the magnetic gap of the circuit breaker.

The trip lever can be made of a magnetic material or a non-magnetic material such as stainless steel. Furthermore, the tab of the yoke can be integrally or separately formed from the yoke. The tab of the yoke can be made of a non-magnetic material, such as plastic, if the trip lever is made of a magnetic material.

BRIEF DESCRIPTION OF THE DRAWINGS

The description of the various exemplary embodiments is explained in conjunction with the appended drawings, in which.

DETAILED DESCRIPTION

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "front," "back," "top," "bottom," "left," "right," "upper," "lower," "down," "up," "side," and the like, used in the written description are for clarity in specific reference to the drawings and are not intended to limit the scope of the invention.

Figure 1:
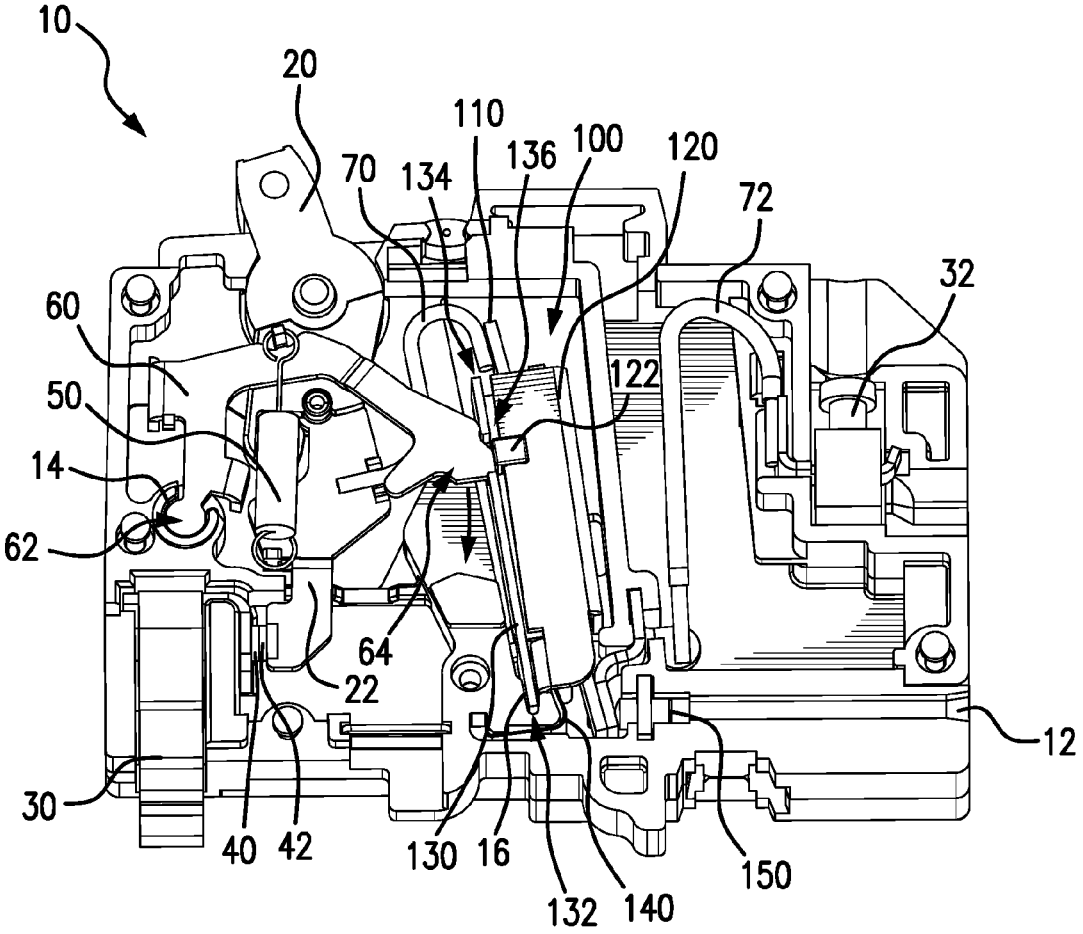
FIG. 1 illustrates a side view of a circuit breaker with one side of a cover removed to show exemplary internal components of the circuit breaker with two electrical contacts engaged in an closed position, in accordance with an embodiment.

FIG. 1 illustrates a side view of a circuit breaker 10, such as a miniature circuit breaker (MCB), with one side of its cover removed to show some of the components thereof. The circuit breaker 10 includes a cover and base (together referred to as cover 12) having compartments and recesses for retaining components of the breaker. The components of the circuit breaker 10 include a movable handle 20 connected to a conductive blade 22 carrying a movable electrical contact 42, a first terminal 30 connected to a stationary electrical contact 40, and a second terminal 32 connected to the blade 22. As shown, the blade 22 is electrically connected to the second terminal 32, by a flexible first conductor 70, a bimetallic member 110 (e.g., bimetal strip) and a second conductor 72. The first terminal 30 can be a line terminal connected to a power line, and the second terminal 32 can be a load terminal connected to a protected load on a branch circuit.

The handle 20 of the circuit breaker 10 is connected to the blade 22 to give the operator the ability to turn the circuit breaker 10 ON (in the closed position) to energize a protected circuit or OFF (in the open position) to disconnect the protected circuit, or to reset the circuit breaker 10 from a tripped position after it trips to protect the circuit. In this example, the handle 20 is pivotably connected via mechanical fastener(s) to the blade 22, but may be movably connected through other types of connections (e.g., a wedge connection such as a tab and slot, a tab and notch, etc.). The handle 20 can be operated to move the blade 22 between the open position to disengage the contacts 40 and 42 from each other and the closed position to engage the contacts 40 and 42.

Figure 2:
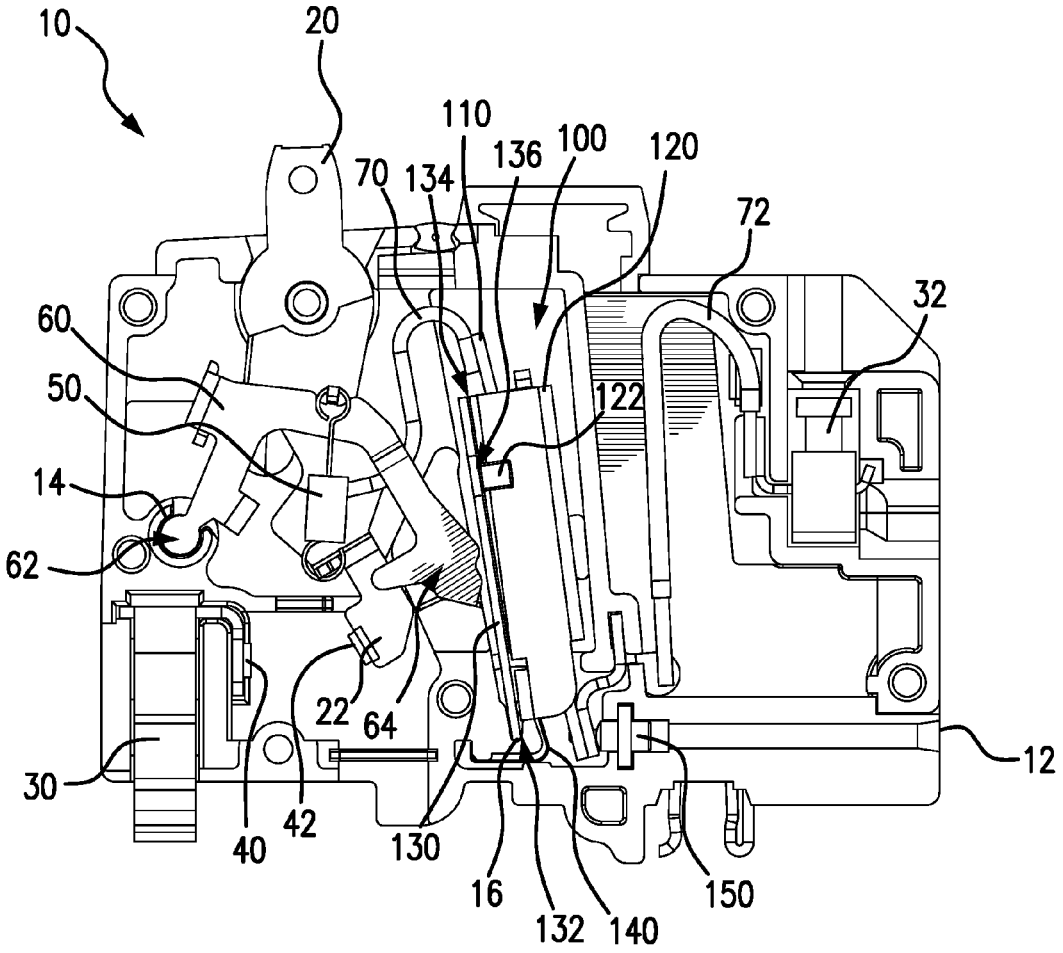
FIG. 2 illustrates a side view of a circuit breaker with one side of a cover removed to show exemplary internal components of the circuit breaker in a tripped position with the two electrical contacts disengaged in an open position, in accordance with an embodiment.

The circuit breaker 10 further includes a trip assembly which, when tripped, causes the blade 22 to move from the closed position as shown in FIG. 1 to the tripped position as shown in FIG. 2, in the event of an anomalous thermal or magnetic condition, hereinafter known as an "overcurrent condition," such as due to a short circuit or overload (e.g., over heating). When the circuit breaker 10 is in the tripped position, the contacts 40 and 42 are disengaged from each other in the open position. The trip assembly of the circuit breaker 10 includes a toggle spring 50, a trip lever 60 and a trip actuator 100. The toggle spring 50 is connected between the blade 22 and the trip lever 60. The trip lever 60 has a first end 62 and an opposite second end 64, and is able to pivot about the first end 62 which is situated in a recess 14 of the cover 12.

The trip actuator 100 includes the bimetallic member 110 (e.g., a bimetal strip), a yoke 120 and an armature 130. The bimetallic member 110 is electrically connected to the blade 22 via the first conductor 70, and is electrically connected to the second terminal 32 via the second conductor 72. An adjustable stop 150 is provided to adjust the position of the bimetallic member 110 inside of the cover 12 of the circuit breaker 10. In the closed position, current is allowed to flow from the first terminal 30, through the bimetallic member 110 and to the second terminal 32. The armature 130 includes a first end 132 and an opposite second end 134, and an opening 136 therebetween that extends from a front side to a back side. The armature 130 is able to pivot about the first end 132, which is situated in a recess 16 of the cover 12. The yoke 120 is arranged adjacent to the back side of the armature 130, and includes a tab 122 that is arranged adjacent to the opening 136 of the armature 130. The tab 122 can be integrally formed with the yoke 120, or a separate component made of the same or different material which is connected to the yoke 120 (e.g., with an adhesive, fastener (s), etc.). In this example, a portion of the tab 122 extends from an edge of the yoke 120. A reset spring 140 provides a force, which biases the yoke 120 and the armature 130 toward the trip lever (e.g., pivots in a counter-clockwise direction about the first end 132 or toward the left in the circuit breaker 10 in FIG. 1). When the circuit breaker 10 is in the closed position as shown in FIG. 1, the second end 64 of the trip lever 60 is latched in the opening 136 of the armature 130, with the yoke 120 being separated from the back side of the armature 130 by a magnetic gap.

The magnetic gap in the trip actuator 100 provides a critical role in the magnetic tripping operation of the trip actuator 100, particularly for overcurrent conditions such as those due to a short circuit or a current exceeding a predetermined threshold or amount. For example, in the event of a short circuit or excessive current, the current through the bimetallic member 110 generates a magnetic field which, in turn, generates magnetic flux in the yoke 120 and the armature 130. The magnetic flux creates an attractive force, which counters the force of the reset spring 140, to move the armature 130 toward the yoke 120 (e.g., pivots in a clockwise direction about the first end 132 or toward the right) and away from the trip lever 60. The movement of the armature 130 causes the second end 64 of the trip lever 60 to disengage and unlatch from the opening 136 of the armature 130 into the tripped position, as shown in FIG. 2. When unlatched, the second end 64 of the trip lever 60 pivots in a downward clockwise direction and causes the blade 22, via the toggle spring 50, to disengage the movable contact 42 from the stationary contact 40 into the open position, thereby interrupting, i.e., terminating, current flow to a load connected to the second terminal 32. Subsequently, the circuit breaker 10 can be reset back to the closed position with the trip lever 60 re-latched in the opening 136 of the armature 130 using the handle 20. As will be described in greater detail below with reference to FIG. 3, the trip lever 60, yoke 120 and armature 130 of the trip assembly of the circuit breaker 10 are configured to control and maintain a consistent magnetic gap (G) between the yoke 120 and the armature 130 in the closed position.

Figure 3:
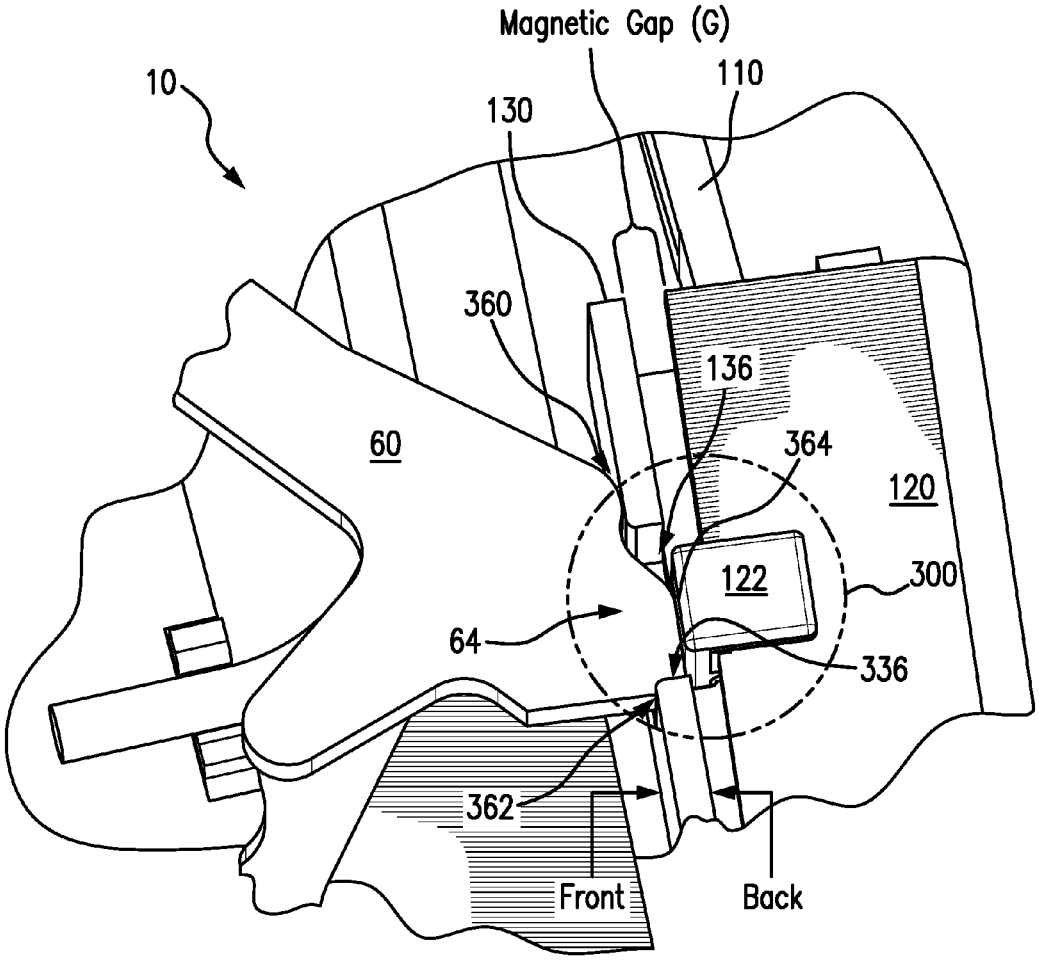
FIG. 3 illustrates an enlarged view of a portion of a trip lever, armature and yoke of the circuit breaker of FIG. 1 with a consistent magnetic gap between the yoke and the armature when the trip lever is latched in an opening of the armature.

FIG. 3 illustrates an enlarged view of a portion of the circuit breaker 10 of FIG. 1 with the second end 64 of the trip lever 60 latched in the opening 136 of the armature 130 when the circuit breaker 10 is in the closed position. As shown, the second end 64 of the trip lever 60 includes a first surface 360, a second surface 362 and a third surface 364 (also referred to as latch surfaces). When the second end 64 of the trip lever 60 is latched in the opening 136 of the armature 130, the first surface 360 (e.g., a bump) is in contact with a front surface of the armature 130, the second surface 362 is in contact with an interior surface 336 of the armature 130 defining the opening 136, and the third surface 364 is in contact with the tab 122 of the yoke 120. The second surface 362 keeps the second end 64 of the trip lever 60 latched in the opening 136 of the armature 130 when the second surface 362 is engaged against a portion of the interior surface 336 of the opening 136. The first surface 360 acts as a stop to control a distance that the third surface 364 extends through the opening 136. The third surface 364 contacts and applies a force against the tab 122 of the yoke 120, which counters the force applied by the spring 140, thereby creating a magnetic gap (G) between the yoke 120 and the armature 130.

The first, second and third surfaces 360, 362 and 364 respectively, along with the opening 136 of the armature 130 and the tab 122 of the yoke 120, are situated in a small or localized area 300 of the circuit breaker 10, and can thus be designed with smaller or lower part/component tolerances to control and provide a consistent magnetic gap when the circuit breaker 10 is in the closed position. When components are manufactured in a small area, tools can be made with higher precision resulting in a very small tolerance stack-up of all the critical part features. For the magnetic tripping operation of the circuit breaker 10, the distance between the yoke 120 and the armature 130 is critical to the accuracy of the magnetic tripping operation of the trip actuator 100 for overcurrent protection, particularly against short circuits. As previously noted, the magnetic gap is a function of the inverse square of the distance. Thus, the magnetic gap needs to be as small as possible to have the most effect on the attractiveness between the yoke 120 and the armature 130. Accordingly, a magnetic gap which is consistent results in predictable tripping levels among the circuit breakers.

The trip lever 60 can be made with a magnetic or a non-magnetic material, such as a non-magnetic steel (e.g., stainless steel). The yoke 120 and the armature 130 are made of a magnetic material. However, the magnetic flux between the yoke 120 and the armature 130 are forced to jump the magnetic gap therebetween when current flows through the bimetallic member 110. Because the trip lever 60 touches both of these parts, the magnetic flux may "short out" through the trip lever 60, thereby changing the magnetic force generated between the yoke 120 and the armature 130. To eliminate this potential shorting effect, the trip lever 60 can be made from a non-magnetic material. Alternatively, the tab 122 of the yoke 120 can be a separate component which is made from a non-magnetic material (e.g., plastic), if the trip lever 60 or its second end 64 is made of a magnetic material. In another embodiment, the third surface 364 can be configured with a size and shape to minimize contact with the tab 122 of the yoke 120 in order to reduce any potential shorting effect between the trip lever 60 and the yoke 120. In a further embodiment, the trip lever 60 can be made of a magnetic material with a high magnetic saturation rate (e.g., a material that quickly becomes magnetically saturated) which would allow the rest of the magnet flux (or sufficient magnet flux) to go across the magnetic gap G and cause movement of the armature 130 toward the yoke 120 in the event of an overcurrent condition.

The trip lever 60 can, for example, be made of a lower magnetic material such as "1010 Cold Rolled Steel" (which has a higher saturation rate) or a more magnetic material such as "305 Stainless Steel" (which has a lower saturation rate). Different types of magnetic steels can be used to change or configure the magnetic characteristics of the trip assembly for a more sensitive or less sensitive tripping system.

The tab 122 can also be configured with a size and/or shape to control a distance that the armature 130 can travel toward the yoke 120 in the event of an overcurrent condition. For example, the tab 122 can have a portion configured with a size and/or shape that is smaller than the opening 136 of the armature 130 to allow the tab 122 to extend freely into the opening 136 from the back side of the armature 130 in the event of an overcurrent condition.

The illustrated embodiments of FIGS. 1-3 are simply provided as examples. The second end 64 of the trip lever 60, the opening 136 of the armature 130 and the tab 122 of the yoke 120 can be configured in different sizes and shapes to control the magnetic gap G. Furthermore, the second end 64 of the trip lever 60 can include three or more latch surfaces, which interact with the components of the yoke 120 and the armature 130 to control and maintain a consistent magnetic gap in the closed position. The various components of the circuit breaker 10 described herein can also be arranged in a different configuration (e.g., size, shape, orientation, etc.) to provide for overcurrent protection, and can include other components such as an arcing chamber, electronics, etc.

Furthermore, the trip lever 60 is described herein as being latched in the opening 136 of the armature 130 when the contacts 40 and 42 are engaged in the closed position, such as when the circuit breaker 10 is ON. However, the trip lever 60 can also be latched in the opening 136 when the contacts 40 and 42 are disengaged in the open position, such as when the circuit breaker 10 is OFF.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions.

The invention claimed is:

1. A circuit breaker comprising:

a first electrical contact connected to a first terminal;

a movable second electrical contact which is engaged to the first electrical contact in a closed position to allow current flow and is disengaged from the first electrical contact in an open position to interrupt current flow;

a trip actuator assembly including:

a movable armature having a front side and a back side with an opening extending from the front side to the back side, a yoke arranged adjacent to the back side of the armature, the yoke including a tab arranged adjacent to the opening on the back side of the armature, a reset spring to apply a force that biases the armature toward the trip lever, and a bimetallic member, electrically connected between the second electrical contact and a second terminal, to generate a magnetic field which produces a magnetic flux in the armature and yoke when current flows through the bimetallic strip, the magnetic flux creating an attractive force, which counters the force of the reset spring, to move the armature toward the yoke in the event of an overcurrent condition; and a pivotable trip lever having an end which is latched in the opening of the armature in the closed position and is unlatched by movement of the armature from the opening of the armature into a tripped position to move the second electrical contact into the open position in the event of the overcurrent condition, the end of the trip lever having first, second and third surfaces, wherein, when the trip lever is latched in the opening, the first, second and third surfaces of the end of the trip lever make contact with a front surface of the armature, an interior surface of the armature defining the opening, and the tab of the yoke, respectively, to provide a consistent magnetic gap between the back side of the armature and the yoke.

2. The circuit breaker of claim 1, wherein the trip lever is made of a non-magnetic material.

3. The circuit breaker of claim 2, wherein the non-magnetic material of the trip lever is stainless steel.

4. The circuit breaker of claim 1, wherein the tab is formed separately from the yoke and is made of a non-magnetic material.

5. The circuit breaker of claim 4, wherein the non-magnetic material of the tab is plastic.

6. The circuit breaker of claim 1, wherein the tab is integrally formed with the yoke.

7. The circuit breaker of claim 1, further comprising:

a movable handle;

a movable blade, connected to the handle, to carry the second electrical contact;

a flexible conductor connected between the movable blade and the bimetallic member; and a toggle spring, connected between the trip lever and the movable blade, to which applies a force on the blade to disengage the second electrical contact from the first electrical contact when the trip lever is unlatched from the armature in the tripped position.

8. The circuit breaker of claim 1, wherein the tab has a portion with a size or shape that is smaller than the opening of the armature to allow the tab to extend into the opening from the back side of the armature in the event of the overcurrent condition.

9. The circuit breaker of claim 1, wherein the trip lever is made of a magnetic material with a high magnetic saturation rate.

* * * * *